US011201024B2

(12) United States Patent
Ehrlich et al.

(10) Patent No.: US 11,201,024 B2
(45) Date of Patent: Dec. 14, 2021

(54) SWITCHGEAR DRIVING ARRANGEMENT

(71) Applicant: SIEMENS AKTIENGESELLSCHAFT, Munich (DE)

(72) Inventors: Frank Ehrlich, Hohen Neuendorf (DE); Andreas Groiss, Falkensee (DE); Rico Rademacher, Ludwigsfelde (DE); Ingolf Reiher, Berlin (DE)

(73) Assignee: Siemens Energy Global GmbH & CO. KG, Munich (DE)

( * ) Notice: Subject to any disclaimer, the term of this patent is extended or adjusted under 35 U.S.C. 154(b) by 0 days.

(21) Appl. No.: 16/606,915

(22) PCT Filed: Mar. 21, 2018

(86) PCT No.: PCT/EP2018/057095
§ 371 (c)(1),
(2) Date: Oct. 21, 2019

(87) PCT Pub. No.: WO2018/192731
PCT Pub. Date: Oct. 25, 2018

(65) Prior Publication Data

US 2020/0388455 A1 Dec. 10, 2020

(30) Foreign Application Priority Data

Apr. 21, 2017 (DE) ..... 10 2017 206 754.3

(51) Int. Cl.
*H01H 33/42* (2006.01)
*H01H 33/662* (2006.01)

(52) U.S. Cl.
CPC ..... *H01H 33/42* (2013.01); *H01H 33/66238* (2013.01); *H01H 2033/66246* (2013.01)

(58) Field of Classification Search
CPC .. H01H 33/42; H01H 33/56; H01H 33/66238; H01H 33/64; H01H 33/6606; H01H 33/662; H01H 33/66207; H01H 33/666; H01H 2033/426; H01H 2033/66246; H01H 1/34; H01H 1/58;
(Continued)

(56) References Cited

U.S. PATENT DOCUMENTS 2,979,587 A * 4/1961 Jennings ..... H01H 33/66238 218/135
5,191,180 A * 3/1993 Kitamura ..... H01H 33/666 218/135
(Continued)

FOREIGN PATENT DOCUMENTS

CN 204375640 U 6/2015
CN 106252151 A 12/2016
(Continued)

*Primary Examiner* — William A Bolton
(74) *Attorney, Agent, or Firm* — Laurence A. Greenberg; Werner H. Stemer; Ralph E. Locher

(57) ABSTRACT

A switchgear driving arrangement includes a transmission element which penetrates a wall of a housing. The transmission element is guided in a linearly movable manner in such a way as to be supported on the wall. A first guide bearing is located inside the housing. A second guide bearing is located outside the housing. An electrical switchgear is also provided.

13 Claims, 1 Drawing Sheet

(58) Field of Classification Search
CPC ..... H01H 2033/66253; H01H 1/5833; H01H 33/66; H01H 2013/066
USPC ..... 218/134, 135, 136, 138, 139, 140, 153, 218/154, 155
See application file for complete search history.

(56) References Cited

U.S. PATENT DOCUMENTS 5,387,771 A * 2/1995 Luehring ..... H01H 33/6644 218/129
5,387,772 A * 2/1995 Bestel ..... H01H 33/66207 218/118
8,110,770 B2 * 2/2012 Ichikawa ..... H01H 33/666 218/134
8,748,770 B2 * 6/2014 Nakayama ..... H02B 13/0354 218/7
8,895,884 B2 * 11/2014 Yamamoto ..... H01H 33/666 218/140
9,082,572 B2 * 7/2015 Yoshida ..... H01H 33/6606
2005/0092713 A1 5/2005 Chyla et al.
2008/0302765 A1 * 12/2008 Renz ..... H01H 33/66207 218/134
2010/0288733 A1 11/2010 Ichikawa et al.
2012/0022797 A1 1/2012 Maruyama et al.
2012/0160810 A1 * 6/2012 Ohtsuka ..... H02B 13/0354 218/140
2014/0042125 A1 * 2/2014 Matsunaga ..... H01H 9/08 218/139

FOREIGN PATENT DOCUMENTS

DE 3529386 A1 2/1987
DE 4201823 A1 7/1993
DE 69522282 T2 5/2002
DE 112009004250 T5 5/2012
DE 102015214509 A1 2/2017
GB 1206297 A 9/1970
WO WO 03071567 A1 8/2003

* cited by examiner

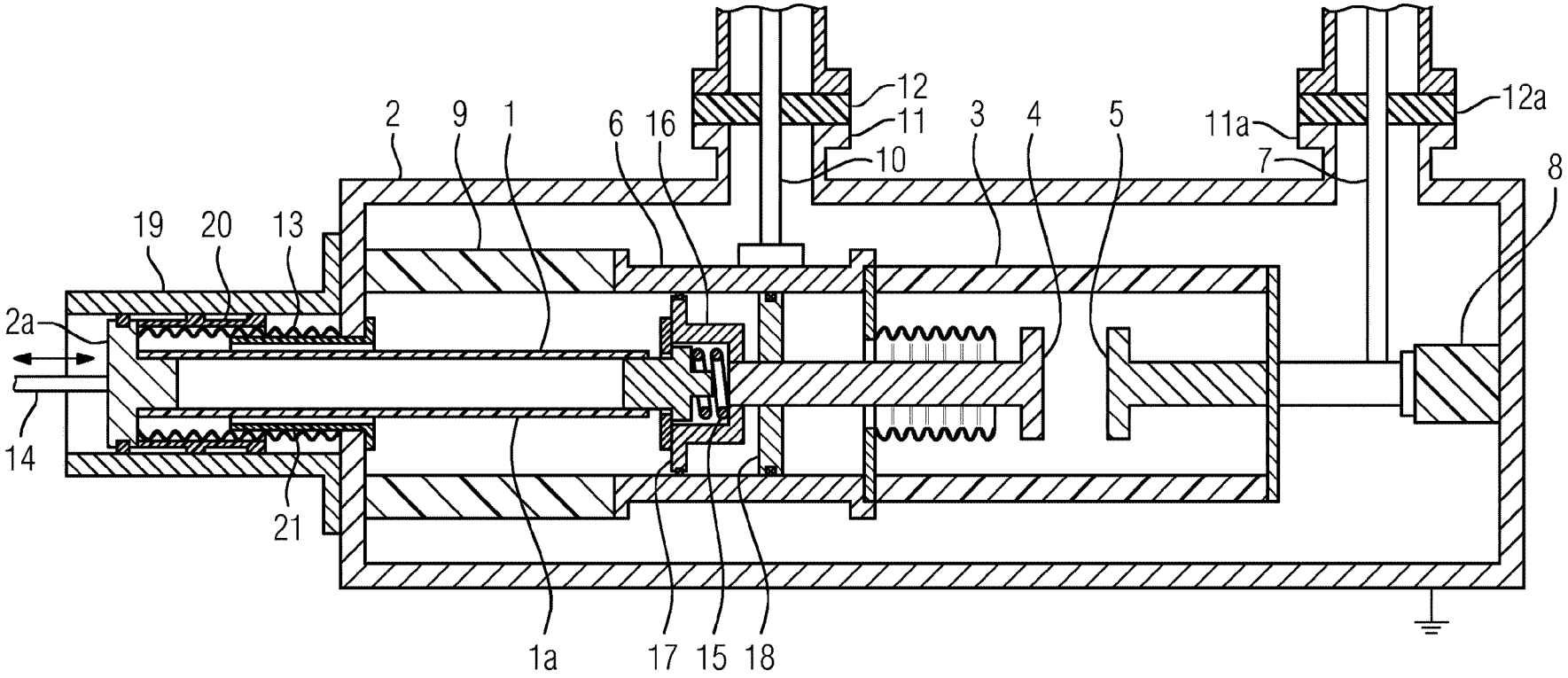
8
12a
7
11a
5
4
3
12
11
10
18
15
17
16
6
1a
1
9
2
13
21
20
19
2a
14

SWITCHGEAR DRIVING ARRANGEMENT

BACKGROUND OF THE INVENTION

Field of the Invention

The invention relates to a switchgear drive arrangement comprising a transmission element for transmitting a movement through a wall of a housing.

A switchgear drive arrangement is known, for example, from DE 42 01 823 A1. The known switchgear drive arrangement has a transmission element which passes through a wall of a housing. In this case, the transmission element is connected to the housing by means of a reversibly deformable section. A movement of the transmission element has to be compensated for in the reversibly deformable section. In this case, forces which can constitute overloading at points can act on the reversibly deformable section. Overloading of the transmission element can lead to premature fatigue phenomena, as a result of which the function of the reversibly deformable section can be limited.

SUMMARY OF THE INVENTION

The object of the invention is therefore to specify a switchgear drive arrangement which prevents overloading.

According to the invention, the object is achieved in the case of a switchgear drive arrangement of the kind mentioned at the outset in that the transmission element is guided such that it is supported in a linearly displaceable manner on the wall of the housing.

A switchgear drive arrangement serves to transmit or generate a drive movement for switching contact pieces, which can move relative to one another, of an electrical switchgear. To this end, the switchgear drive arrangement has a kinematic chain which has a transmission element which passes through a wall of a housing. In this case, the wall can preferably be of fluid-tight design, wherein passage through the wall by means of the transmission element maintains the fluid-tightness of the wall. A fluid-tight transition between the wall and the transmission element can be ensured, for example, by a reversibly deformable section. The housing can surround an interrupter unit/a switching point of the switchgear. The housing can preferably constitute a fluid-tight encapsulation housing which, in its interior, accommodates the interrupter unit/the switching point of the switchgear. The switchgear drive arrangement can have, for example, a drive device is outside the housing, which drive device serves to generate a movement, wherein this movement is transmitted to the switching point of the switchgear by means of the kinematic chain. In this case, the switchgear can have switching contact pieces which can be moved relative to one another and which can be moved relative to one another by the drive device.

A movement to be transmitted can pass the wall of the housing by means of a linearly displaceable transmission element. The transmission element itself can preferably be supported in a displaceable manner against the wall itself, wherein the transmission element passes through the wall. In this case, passage through the wall preferably takes place in a fluid-tight manner. For example, a sliding seal can be arranged between the transmission element and the wall for this purpose. However, provision can also be made for one section to be embodied in a reversibly deformable manner, wherein the transmission element is connected in a fluid-tight manner to the wall by means of the reversibly deformed section. By way of example, a cohesive bond between the transmission element and the wall can be provided by means of the deformable section. The transmission element can be formed, for example, in the manner of a switching rod which extends inside or outside the housing. The transmission element can possibly be composed of a plurality of sections, so that a permanent fluid-tight bond between the switching rod and the wall of the housing can be achieved. Guidance of the transmission element is ensured owing to the transmission element being supported against a wall of the housing, so that undesired buckling or tilting of the transmission element is prevented. As a result, a defined movement is transmitted through the wall, as a result of which undesired loading, in particular of sealing elements between the wall and the transmission element, is avoided. This ensures permanent, low-wear transmission of a movement by means of the transmission element. The transmission element can be, for example, a switching rod which has different sections, wherein the sections are arranged so as to follow one another in order to transmit a linear movement by means of the transmission element. Therefore, the switching rod can have, for example, contact-pressure springs, sealing elements, metal or electrically insulating sections etc.

The transmission element can be supported, for example, by means of a guide bearing. The use of a plurality of guide bearings, which are arranged axially spaced apart from one another, can preferably be provided for the purpose of ensuring linear guidance of the transmission element, as a result of which stable linear guidance of the transmission element can be ensured. Examples of guide bearings include sliding bearings or roller bearings in order to provide linear guidance of the transmission element.

In addition to the axial displaceability of the transmission element, a superimposing rotational movement can also be provided. For example, rotation of the transmission element about the displacement axis can be permitted.

A further advantageous refinement can make provision for the transmission element to be guided such that it is supported in a linearly displaceable manner within the housing.

The housing surrounds, in its interior, the interrupter unit of a switchgear. A movement can be transmitted to at least one of several switching contact pieces, which can be moved relative to one another, by means of the transmission element. Owing to the transmission element being supported within the housing, the transmission element can firstly be supported in order to ensure transmission of a movement through a wall of the housing in as straight a manner as possible. However, in addition, the transmission element, by way of its stabilized bearing, can also serve to guide a switching contact piece. Therefore, a guide bearing which is arranged within the housing can firstly stabilize a movement of the transmission element. Secondly, a movement of a switching contact piece can also be stabilized by means of this guide bearing. As a result, the transmission behavior of the kinematic chain can be improved. Inaccuracies and undesired elasticities within the kinematic chain are countered in this way. Furthermore, owing to the transmission element being supported or guided within the housing, this guidance through the housing is protected against access from the outside. Therefore, for example, delicate mechanical systems which are protected against soiling by the housing can be used. Furthermore, guidance in the interior of the housing can also serve to provide an electrical contact-connection, for example, of a switching contact piece at least in sections by means of a guide bearing for the transmission element. In particular, in the case of stabilization both of a transmission element and also of a switching contact piece by a guide bearing, this is advantageous in order to achieve stabilization as close as possible to a relatively movable switching contact piece. To this end, for example, electrical sliding contact arrangements can be used as part of a guide bearing. Support can advantageously take place on the housing.

A further advantageous refinement can make provision for the transmission element to be guided such that it is supported in a linearly displaceable manner outside the housing.

Outside an encapsulation housing, it is possible to provide simplified access to a guide bearing. Furthermore, the installation space in the interior of the housing is generally limited, and therefore linear guidance of the transmission element outside the housing reduces the number of internals within the housing. In this case, it is advantageous when stabilization of the transmission element takes place relative to the wall of the housing through which the transmission element passes. In an advantageous case, linear guidance of the transmission element can be provided both inside and also outside the housing. To this end, a guide bearing can respectively be arranged, for example, inside and also outside the housing. Outside the housing, the construction of the guide bearing can be of correspondingly robust design since the installation space is not limited by the housing.

A further advantageous refinement can make provision for a first guide bearing to be arranged on a phase conductor of a switchgear.

A switching point of a switchgear serves to interrupt or to switch a current path/a phase conductor. The current path/a phase conductor can be electrically switched, for example, by means of switching contact pieces which can be moved relative to one another. A first guide bearing can be arranged on a phase conductor of this kind. To this end, the electrical potential which is carried by the respective phase conductor is applied to the first guide bearing at is least in sections. By way of example, the phase conductor in the form of a bearing sleeve can function as a guide bearing, wherein linear displaceability of the transmission is element is provided. By way of example, the transmission element in the form of a piston can enter the bearing sleeve. As a result, it is furthermore possible to use the first guide bearing for making electrical contact with a switching contact piece which can be moved relative to a further switching contact piece. Furthermore, it is possible to stabilize and to support a movable switching contact piece by means of the first guide bearing. Therefore, the first guide bearing can serve firstly to stabilize a linear movement of the transmission element and also to stabilize a movement of a switching contact piece of the switchgear.

Furthermore, provision can advantageously be made for a second guide bearing to guide a fluid-tight section for closing an opening in the wall.

A second guide bearing serves to stabilize a movement of the transmission element. In this case, the second guide bearing can guide a portion of a fluid-tight section. The fluid-tight section can be formed by the transmission element. The fluid-tight section can be part of the housing. By way of example, a fluid-tight section of a transmission element can be displaceably mounted in a bearing sleeve. Therefore, it is possible to realize fluid-tight passage through the wall by means of the transmission element. By way of example, the fluid-tight section can be sealed in relation to the fluid-tight wall by means of a set of folding bellows which can be deformed in the manner of a set of bellows. The transmission element, for example, can be inserted in a fluid-tight manner (for example in the form of a washer) into a set of bellows. The fluid-tight section/this washer can be guided in a displaceable manner in a bearing sleeve. A bearing sleeve can serve as a second guide bearing.

Provision can advantageously be made for a second guide bearing to have a bearing sleeve on which the transmission element is supported in a displaceable manner.

A bearing sleeve can serve to guide the transmission element, wherein the transmission element is guided in an axially displaceable manner in the bearing sleeve. The bearing sleeve can be supported, for example, against the housing, wherein a reversibly deformable section can be arranged within the bearing sleeve for the purpose of sealing off the transmission element. Therefore, the bearing sleeve can serve to guide the transmission element. Furthermore, the bearing sleeve can provide for mechanical stabilization of the reversibly deformable section and also for mechanical protection.

To this end, provision can further advantageously be made, for example, for the bearing sleeve to engage around a reversibly deformable section of the wall.

A reversibly deformable section can be, for example, a set of folding bellows of which the axial extent can be varied substantially in the axial direction. By way of example, a fluid-tight section, for example of a transmission element, can be attached in a fluid-tight manner to the end side of the reversibly deformable section, said fluid-tight section providing for the reversibly deformable section to be is terminated at the end side. Linear guidance of the transmission element within the bearing sleeve can also be provided by means of this end-side termination. In this is case, the bearing sleeve can engage around the outer lateral surface of the reversibly deformable section, so that buckling or bowing of the reversibly deformable section is prevented in the event of transformation of the reversibly deformable section. Therefore, positive guidance both of the guided fluid-tight section and also of the reversibly deformable section (folding bellows) is ensured within the bearing sleeve. In this case, the bearing sleeve does not have a sealing-off function on the housing, and therefore lateral openings, through which access from the outside or monitoring of the reversibly deformable section is possible, can also be provided in said bearing sleeve for example.

Furthermore, provision can advantageously be made for a spacer to be arranged between the bearing sleeve and the reversibly deformable section.

Transformation of the reversibly deformable section can result in bowing or deflection of the reversibly deformable section in the radial direction. Deflection can be limited by the bearing sleeve. Direct contact between the bearing sleeve and the reversibly deformable section can be prevented by the use of a spacer between the deformable section and the bearing sleeve. Particularly in the case of bellows-like folding of the reversibly deformable section, the friction between the reversibly deformable section and the bearing sleeve can be reduced in this way. The spacer can be arranged between mutually facing surfaces of the is bearing sleeve and the reversibly deformable section. By way of example, the spacer can be formed from friction-reducing material. By way of example, the spacer, as an intermediate sleeve, for example composed of PTFE, can render possible low-fiction relative sliding of the bearing sleeve and the reversibly deformable section. As a result, excessive wear at prominent points of the reversibly deformable section is prevented.

Furthermore, provision can advantageously be made for the spacer to be displaceable relative to the bearing sleeve.

The spacer can be arranged in a displaceable manner relative to the bearing sleeve, so that said spacer is moved, for example, jointly with a movement of the transmission element. In a preferred case, this causes a relative movement between the spacer and the bearing sleeve with greater travel than a relative movement of the spacer to points of the reversibly deformable section that are at risk of wear. Furthermore, this makes it possible, for example, to also arrange a further spacer on the inner lateral surface of the reversibly deformable section, so that improved guidance (on the inside and on the outside) and preferred transformation of the reversibly deformable section are enforced in the event of the spacer and the further spacer sliding one in the other with the interposition of the reversibly deformable section of the wall of the housing. In addition to improved linear guidance of the transmission element, transformation of the reversibly deformable section can take place in a preferred manner in this way, as a result of which premature aging of the reversibly deformable section as a result of material fatigue at points is countered.

Provision can advantageously be made for the first guide bearing and the second guide bearing to stabilize a linear movement of the transmission element in a manner arranged in alignment with one another.

Aligned arrangement of the first and the second guide bearing in a manner spaced apart from one another renders possible improved support of the transmission element. A tendency of the transmission element to break open is countered owing to the guide bearings being spaced apart from one another. A wall of the housing can preferably be arranged between the two guide bearings, as a result of which it is possible to secure both the first and also the second guide bearing relative to the housing in each case, wherein the first and the second guide bearing can be secured independently of one another. In this way, a base is formed by means of the housing in order to perform adjustment both of the first and also of the second guide bearing.

A further advantageous refinement can make provision for the housing to be a pressure vessel.

The housing can be designed as a fluid-tight encapsulation housing, as a result of which a fluid can be incorporated and encapsulated in the interior of the housing. If the housing is designed as a pressure vessel, the fluid in the interior of the housing can have a different pressure to that of the surrounding area. As a result, it is possible to create a differential pressure between the interior of the housing and the exterior of the housing. By way of example, a higher pressure can be created in the interior of the housing than in the area surrounding the housing. However, provision can also be made for a pressure which is reduced in comparison to the surrounding area, for example a vacuum, to be present in the interior of the housing, so that the housing is subject to a differential pressure which the housing withstands. The housing can encapsulate, for example, an electrically insulating fluid or a vacuum. Suitable fluids are, for example, fluoride-containing gases such as sulfur hexafluoride, fluoronitriles, fluoroketones, or else other fluids such as, for example, carbon dioxide, nitrogen, oxygen or corresponding fluid mixtures. The fluid can preferably be in gaseous form in the interior of the housing.

A further advantageous refinement can make provision for a switching point of a switching device to be arranged within the housing.

An electrical switching device serves to switch or interrupt a current path, wherein switching contact pieces which can be moved relative to one another are preferably used for this purpose. A switching point is formed between the switching contact pieces in order to interrupt or connect the switchable current path of the switching device. A kinematic chain comprising the transmission element can be used for the purpose of generating a relative movement of the switching contact pieces of a switching point. The switching point is mechanically protected by the housing. Furthermore, the housing can include a particular atmosphere, as a result of which the switching point itself is likewise exposed to this atmosphere. By way of example, an electrically insulating fluid, see above, can preferably be arranged within the housing, it also being possible for the switching point to be flushed with said electrically insulating fluid. Given suitable selection of the electrically insulating fluid, interruption or occurrence of switching arcs can be reduced or quenching of the switching arcs can be assisted. A switching point can also be arranged within a closed-off environment (bottle in a bottle) within the housing. By way of example, a vacuum tube, within which the switching point is arranged, can be arranged in the housing.

Provision can advantageously be made for the switching point to be at least partially supported against the housing.

The switching point can advantageously be supported against the housing. This has the advantage that both the switching point, that is to say the location at which a movement is to be transmitted by means of the transmission element, and also the transmission element are supported against the same base. As a result, an adjustment both of the switching point and also of the transmission element can be made relative to the housing independently of one another. As a result, a movement can be executed in a particularly exact and reproducible manner. In this way, the loading on the transmission element and therefore also on the switching point is reduced, as a result of which a switchgear drive arrangement which is stable over the long term is provided.

A further advantageous refinement can make provision for the first guide bearing and the second guide bearing to be arranged such that they are electrically insulated from one another.

Electrically insulating separation of the first and the is second guide bearing makes it possible for the guide bearings on one switchgear arrangement to have different electrical potentials. In this case, the two guide bearings can be connected by means of the transmission element. In order to also ensure electrical insulation of the two guide bearings here, the transmission element can have an electrically insulating effect at least in sections. An electrically insulating section is preferably guided or supported by the first or second guide bearing at the end side in each case. The transmission element can have, for example, an electrically insulating drive rod. The drive rod can be formed, for example, by a hollow tube which extends at least within the housing. Owing to the electrically insulated arrangement of the guide bearings in relation to one another, a guide bearing can be guided closely past a switching contact piece of the switching point, which switching contact piece carries an electrical potential. By way of example, a guide bearing can be integrated into a phase conductor of a switching point. Furthermore, a guide bearing can also be designed, for example, as part of the housing and carry, for example, ground potential there. As a result, it is possible to linearly guide the transmission element by guide bearings which are positioned in a manner spaced apart from one another, wherein the linear guidance of the transmission element can be performed in an exact manner on account of the axial spacing.

A further object of the invention is to propose a suitable use of the switchgear drive arrangement. According to the invention, provision is made to this end for a switchgear comprising switching contact pieces which can be driven relative to one another to have a switchgear drive arrangement having the features described above.

An electrical switchgear serves to switch or interrupt a current path. To this end, the switching device has switching contact pieces which can be moved relative to one another. In order to generate a relative movement of the switching contact pieces in relation to one another, it is preferred to provide for the use of a switchgear drive arrangement having the features described above. Therefore, a movement can be generated outside a housing, for example, by a drive device via the switchgear drive arrangement, wherein a movement through a wall of the housing into the interior of the housing can be transmitted to a switching point of the switchgear.

A transmission element which can complete a linear movement in a manner supported by means of a guide bearing can accordingly be used as part of the kinematic chain. This linear movement can be transmitted as far as to the switching point. There, the linear movement can be transformed, for example, by means of a gear mechanism.

An exemplary embodiment of the invention is shown in a schematic drawing and then described below.

BRIEF DESCRIPTION OF THE SINGLE VIEW OF THE DRAWING

The FIGURE shows a section through a switchgear drive arrangement and also a switchgear which comprises the switchgear drive arrangement.

DESCRIPTION OF THE INVENTION

The switchgear drive arrangement has a transmission element 1. The transmission element 1 is mounted in a linearly displaceable manner. In this case, the transmission element 1 passes through a housing 2. The housing 2 is embodied as a fluid-tight pressure vessel, wherein a switching point 3 is arranged in the interior of the housing 2. In the is present case, the switching point 3 is designed as a vacuum tube which is formed in a substantially rotationally symmetrical manner, wherein a first switching contact piece 4 and a second switching contact piece 5 protrude into the interior of the vacuum tube at the end side. The two switching contact pieces 4, 5 are oriented coaxially in relation to one another, wherein the first switching contact piece 4 is arranged in an axially movable manner. The second switching contact piece 5 is arranged in a stationary manner. In order to fix the switching device in a stationary manner within the housing 2, a first subsection 6 and also a second subsection 7 of a phase conductor run are connected to the switching point 3 at a fixed angle. In this case, the first subsection 6 is electrically conductively connected to the first switching contact piece 4 and the second subsection 7 is electrically conductively connected to the second switching contact piece 5. A supporting insulator 8 is arranged on the inner wall of the housing 2 for the purpose of supporting the second subsection 7. The supporting insulator 8 holds the second subsection 7 at a fixed angle relative to the housing 2. The end side of the switching device 3, on which end side the second switching contact piece 5 is arranged, is secured at a fixed angle relative to the housing 2 by means of the connection of the second subsection 7 of the phase conductor. The first subsection 6 is of substantially hollow-cylindrical design and supports the end side of the switching device 3, on which end side the first switching contact piece 4 is arranged in a movable manner. In order to stabilize the first subsection 6 and therefore also the switching point 3, a hollow post insulator 9 is arranged on the first subsection 6, specifically at that end which is averted from the switching point 3. Therefore, an electrically insulating connection between an inner wall of the housing 2 and the first subsection 6 is provided by means of the hollow post insulator 9. A branch 10, by means of which the phase conductor is guided outward through a wall of the housing 2 starting from the first subsection 6, is arranged on the lateral surface of the first subsection 6. For the purpose of electrically insulated guidance of the branch 10, a lateral surface-side connection piece 11 is blocked by a disk insulator 12 through which the branch 10 passes in a fluid-tight manner. Further assemblies, such as an outdoor bushing or further housing assemblies for example, can now be flange-connected to the lateral surface-side connection piece 11. Analogously to conducting the branch 10 out through a wall of the housing 2, the second subsection 7 is electrically insulated by a further lateral surface-side connection piece 11*a* and also a further disk insulator 12*a* and guided out of the interior of the housing 2 to the outside in a fluid-tight manner. In the present case, provision is made for the housing 2 to be formed substantially from an electrically conductive material to which ground potential is applied.

The transmission element 1 passes through the hollow post insulator 9 and continues within the first subsection 6 of the phase conductor as far as to the first switching contact piece 4. In this case, the transmission element 1 is composed of a plurality of sections. The transmission element 1 has, for example, an electrically insulating tubular section 1*a*. The electrically insulating tubular section 1*a* is connected, by way of its end which is averted from the switching point 3, to a disk-like section 2*a* of the transmission element 1. The disk-like section 2*a* closes is an opening in the housing 2 by means of a so-called set of folding bellows 13 (reversibly deformable section). The set of folding bellows 13 is closed, at one of its end sides, by the disk-like section 2*a* in a fluid-tight manner. At its other end, the set of folding bellows 13 is connected at the end side to a fixed-angle section of the housing 2 (so as to engage around the opening) in a fluid-tight manner. The transmission element 1 continues beyond the disk-like section 2*a* outside the housing in a drive rod 14. At an end of the transmission element 1 that faces the switching device 3, the transmission element 1 has a contact-pressure spring 15 which is arranged in a spring housing 16. The spring housing 16 is provided with a guide collar 17, so that the spring housing 16 of the transmission element 1 is guided in a sliding manner centrally within the hollow-cylindrical recess of the first subsection 6 of the phase conductor. In addition, a contact disk 18 is arranged in the course of the transmission element 1. The contact disk 18 is electrically conductively connected to the first switching contact piece 4. The contact disk 18 slides in the same hollow-cylindrical recess of the first subsection 6 as the guide collar 17 of the spring housing 16. If required, an electrical contact-connection can be made both by means of the contact disk 18 and also additionally by means of the spring housing 16 in order to ensure a movable electrically conductive contact-connection between the first switching contact piece 4 and the phase conductor, which is to be interrupted, by means of the first subsection 6.

The outer lateral surface of the folding bellows 13 is surrounded by a bearing sleeve 19. The bearing sleeve 19 is arranged outside the housing 2. The bearing sleeve 19 is receives, in its hollow-cylindrical recess, the disk-like section 2*a*, so that said disk-like section is guided in a linearly displaceable manner. A spacer 20 is arranged in is the annular gap which is formed on the inner lateral surface side in the bearing sleeve 19 and the outer lateral surface side on the periphery of the folding bellows 13. In the present case, the spacer 20 is of substantially hollow-cylindrical design, wherein said spacer is fixed to the disk-like section 2*a* at the end side. In order to reduce the friction on the outer periphery, annular shoulders which run in an axially spaced apart manner are arranged on the spacer 20. An additional spacer 21 is arranged in the interior of the housing 2 between the inner wall of the folding bellows 13 and the electrically insulating tubular section 1*a*. The additional spacer 21 is connected to the housing 2 in a stationary manner, wherein the axial extent both of the spacer 20 and also of the additional spacer 21 is selected in such a way that overlapping of the two spaces 20, 21 (with the interposition of the folding bellows 13) is always ensured. Owing to the spacers 20, 21, guidance of the folding bellows 13 is ensured in the event of deformation of said folding bellows.

A first guide bearing for the transmission element 1 is provided within the first subsection 6 by means of the guide collar 17 there and, respectively, the contact disk 18. The first guide bearing is therefore arranged on a phase conductor of the switchgear. The first guide bearing is arranged within the housing 2. A second guide bearing is formed on the bearing sleeve 19 within which the disk-like section 2*a* is guided in a displaceable manner. The disk-like section 2*a* of the transmission element 1 is guided on the second guide bearing outside the housing 2. The guide is bearings are each arranged, at the end side, on the electrically insulating tubular section 1*a*. The bearing sleeves both of the first guide bearing and also of the second guide bearing are oriented in a stationary manner in relation to the housing 2. In this case, the two guide bearings are oriented in alignment with one another in the axial direction, so that a linear movement of the transmission element 1 (in particular of the electrically insulating section/electrically insulating tubular section 1*a*) is guided both inside the housing 2 and also outside the housing 2. In the event of a switch-on process (the FIGURE shows a switched-off state of the switching point 3), a movement is output from the drive device which is coupled to the transmission element 1, wherein a linear movement of the transmission element 1 takes place, as a result of which the first switching contact piece 4 moves closer to the second switching contact piece 5. In this case, the transmission element 1 is linearly guided both by means of the first guide bearing and also by means of the second guide bearing. Contact being made between the first switching contact piece 4 and the second switching contact piece 5 results in excessive travel of the drive device, as a result of which the contact-pressure spring 15 is compressed. Therefore, starting from the transmission element 1, a contact force is generated between the first switching contact piece 4 and the second switching contact piece 5. The phase conductor is switched on. During the switch-on process, the set of folding bellows 13 is compressed, wherein the overlap between the two spacers 20, 21 increases, as a result of which increased guidance of the folding of the set of folding bellows 13 takes place.

In the event of a switch-off process, the direction of the is movement of the transmission element 1 is reversed. In this case, the contact-pressure spring 15 is initially relieved of tension, this being followed by the first switching is contact piece 4 being moved away from the second switching contact piece 5 until the switch-off position is reached.

The interior of the housing 2 can be filled with an electrically insulating fluid under excess pressure. This electrically insulating fluid is preferably present in gaseous form in the interior of the housing 2. By way of example, sulfur hexafluoride, fluoroketone, fluoronitrile, carbon dioxide, nitrogen, oxygen and other electronegative substances, preferably in a mixture, have proven themselves as electrically insulating fluids. The switchgear drive arrangement shown in the FIGURE and, respectively, the switching device 3 shown can be used, for example, in a so-called gas-insulated switchgear installation or else in an outdoor switchgear. In addition to the single-pole electrical insulation shown in FIG. 1, variants with multiple-pole electrical insulation, that is to say with a plurality of phase conductors, which are electrically insulated from one another, arranged within one and the same housing 2, can also be used.

The invention claimed is:

1. A switchgear drive arrangement, comprising:

a housing having a wall, said wall having a reversibly deformable section;

a guide bearing having a bearing sleeve, said bearing sleeve engaging around said reversibly deformable section;

a transmission element for transmitting a movement through said wall of said housing, said transmission element being guided and supported for linear displacement on said wall of said housing and said transmission element being displaceable in sliding contact with said bearing sleeve and being supported for linear movement by said bearing sleeve;

said bearing sleeve protecting said reversibly deformable section and said transmission element against external mechanical influences; and a spacer disposed between said bearing sleeve and said reversibly deformable section along at least part of a length of said reversibly deformable section.

2. The switchgear drive arrangement according to claim 1, wherein said transmission element is guided and supported within said housing for linear displacement.

3. The switchgear drive arrangement according to claim 1, wherein said transmission element is guided and supported outside said housing for linear displacement.

4. The switchgear drive arrangement according to claim 1, which further comprises a phase conductor of a switchgear, and a first guide bearing disposed on said phase conductor.

5. The switchgear drive arrangement according to claim 4, which further comprises a fluid-tight section for closing an opening in said wall, and a second guide bearing guiding said fluid-tight section.

6. The switchgear drive arrangement according to claim 5, wherein said first guide bearing and said second guide bearing stabilize a linear movement of said transmission element in alignment with one another.

7. The switchgear drive arrangement according to claim 5, wherein said first guide bearing and said second guide bearing are electrically insulated from one another.

8. The switchgear drive arrangement according to claim 4, wherein said guide bearing having a said bearing sleeve is a second guide bearing.

9. The switchgear drive arrangement according to claim 1, wherein said spacer is displaceable relative to said bearing sleeve.

10. The switchgear drive arrangement according to claim 1, wherein said housing is a pressure vessel.

11. The switchgear drive arrangement according to claim 1, which further comprises a switching point of a switchgear being disposed within said housing.

12. The switchgear drive arrangement according to claim 11, wherein said switching point is at least partially supported against said housing.

13. An electrical switchgear, comprising:

switching contact pieces configured to be driven relative to one another; and a switchgear drive arrangement according to claim 1 for driving one of said switching contact pieces.

* * * * *